US012729463B2

(12) United States Patent
Pinon et al.

(10) Patent No.: US 12,729,463 B2
(45) Date of Patent: Sep. 8, 2026

(54) CLOTHING ARTICLES HAVING ULTRA-HIGH MOLECULAR WEIGHT POLYETHYLENE

(71) Applicant: SHEERTEX INC., Anjou (CA)

(72) Inventors: Anel Pinon, Montreal (CA); David Reagan, Fort Payne, AL (US)

(73) Assignee: SHEERTEX INC., Anjou (CA)

( * ) Notice: Subject to any disclaimer, the term of this patent is extended or adjusted under 35 U.S.C. 154(b) by 107 days.

(21) Appl. No.: 18/860,444

(22) PCT Filed: Apr. 26, 2023

(86) PCT No.: PCT/CA2023/050564

§ 371 (c)(1),
(2) Date: Oct. 25, 2024

(87) PCT Pub. No.: WO2023/205893

PCT Pub. Date: Nov. 2, 2023

(65) Prior Publication Data

US 2025/0290238 A1 Sep. 18, 2025

Related U.S. Application Data

(60) Provisional application No. 63/335,514, filed on Apr. 27, 2022.

(51) Int. Cl.

| | |
|---|---|
| ***D04B 1/12*** | (2006.01) |
| ***D04B 1/14*** | (2006.01) |
| ***D04B 1/24*** | (2006.01) |

(52) U.S. Cl.

CPC ..... *D04B 1/12* (2013.01); *D04B 1/14* (2013.01); *D04B 1/24* (2013.01); *D04B 1/246* (2013.01);

(Continued)

(58) Field of Classification Search

CPC ..... D04B 1/12; D04B 1/123; D04B 1/126; D04B 1/14; D04B 1/16; D04B 1/18;

(Continued)

(56) References Cited

U.S. PATENT DOCUMENTS

| | | | | |
|---|---|---|---|---|
| 10,954,612 | B2 * | 3/2021 | Hague | D04B 1/08 |
| 2010/0050699 | A1 * | 3/2010 | Kolmes | D04B 1/28 66/178 R |

(Continued)

*Primary Examiner* — Danny Worrell

(74) *Attorney, Agent, or Firm* — Smart & Biggar LP; Carmel De Luca

(57) ABSTRACT

A clothing article is disclosed herein, comprising: at least one base knit region, each base knit region being formed of a base knit comprising an ultra-high molecular weight polyethylene (UHMWPE) fiber and at least one base stretch fiber being knit together in a plated configuration to form a jersey knit; and at least one reinforcing knit region, each reinforcing knit region being formed of a reinforcing knit comprising the UHMWPE fiber and the at least one base stretch fiber being knit together in a plated configuration to form a jersey knit. The reinforcing knit region further comprising a reinforcing stretch fiber being alternatingly knit with the jersey knit of the reinforcing knit in which within each given course of the jersey knit of the reinforcing knit, for every sequence of m +n consecutive loops of the course, the reinforcing stretch fiber is looped with m consecutive loops of the jersey knit of the reinforcing knit and n consecutive loops of the jersey knit of the reinforcing knit are free of looping with the reinforcing stretch fiber.

16 Claims, 8 Drawing Sheets

(52) U.S. Cl.
CPC .. *D10B 2321/0211* (2013.01); *D10B 2501/02* (2013.01)

(58) Field of Classification Search
CPC ... D04B 1/24; D04B 7/24; D04B 7/28; D04B 9/36; A41B 17/00
See application file for complete search history.

(56) References Cited

U.S. PATENT DOCUMENTS

| | | | | |
|---|---|---|---|---|
| 2016/0017521 | A1* | 1/2016 | Thomson | D03D 1/0041 428/221 |
| 2018/0368483 | A1* | 12/2018 | Hague | D04B 1/16 |
| 2022/0010468 | A1* | 1/2022 | Hague | D04B 1/08 |
| 2022/0056620 | A1* | 2/2022 | Hague | D04B 1/16 |
| 2024/0352632 | A1* | 10/2024 | Hague | D04B 1/12 |
| 2025/0290238 | A1* | 9/2025 | Pinon | D04B 1/12 |

* cited by examiner

CLOTHING ARTICLES HAVING ULTRA-HIGH MOLECULAR WEIGHT POLYETHYLENE

RELATED APPLICATIONS

This Patent Cooperation Treaty application claims the benefit of priority of U.S. Provisional Application No. 63/335,514 filed on Apr. 27, 2022, which is incorporated herein in its entirety.

TECHNICAL FIELD

The present disclosure generally relates to clothing articles comprising ultra-high weight polyethylene (UHMWPE).

BACKGROUND

UHMWPE fiber produced from polyethylene resins of ultra-high molecular weight possesses high performance tensile properties such as tensile strength, tensile modulus and energy-to-break. Clothing articles comprising UHMWPE fiber may benefit from the high-performance properties of the UHMWPE fiber.

Seamless garments generally refer to garments which are constructed in a single and continuous knitting process. This process eliminates side seams and requires less sewing and stitching as well as fewer joints. Seamless garments provide increased comfort and aesthetics and are now widely used for various types of garments, including close-fitting physical fitness clothes such as leggings, shirts, tops as well as shapewear, bras and underwear. Seamless undergarments have gained popularity over the years. Their confection provides less chafing from fewer seams, as well decreased visibility under clothing, a smoother finish and flattering silhouette.

A drawback of seamless undergarments, in particular seamless bras, is that while they provide greater comfort, they may not provide as much breast support as traditional seamed bras, for example brassieres with underwire. In addition, seamless bras without any molded cups tend to create a mono-boob or compressed look. Molded or separate cups allow the bust to sit neatly and for the breasts to be separated. Increased sheerness and thinness in areas of the undergarment may be pleasant and comfortable, for example the breast area or the buttock area. However, increasing the sheerness of the material often is detrimental to its resistance and tensile strength.

As such, there remains a need for clothing articles, in particular seamless undergarments, that display a desirable level of sheerness, while providing support, tensile strength, resistance to rip as well as an appealing profile for the user.

SUMMARY

According to one aspect, there is provided a clothing article, comprising:

at least one base knit region, each base knit region being formed of a base knit comprising an ultra-high molecular weight polyethylene (UHMWPE) fiber and at least one base stretch fiber being knit together in a plated configuration to form a jersey knit; and at least one reinforcing knit region, each reinforcing knit region being formed of a reinforcing knit comprising the UHMWPE fiber and the at least one base stretch fiber being knit together in a plated configuration to form a jersey knit, the reinforcing knit region further comprising a reinforcing stretch fiber being alternatingly knit with the jersey knit of the reinforcing knit in which within each given course of the jersey knit of the reinforcing knit, for every sequence of m+n consecutive loops of the course, the reinforcing stretch fiber is looped with m consecutive loops of the jersey knit of the reinforcing knit and n consecutive loops of the jersey knit of the reinforcing knit (following the m consecutive loops) are free of looping with the reinforcing stretch fiber.

In some embodiments, the at least one base knit region and the at least one reinforced knit region are integrally formed from a continuous knitting operation.

In some embodiments, m is equal to or greater than 1 and n is equal to or greater than 1.

In some embodiments, the at least one reinforcing knit region comprises at least one vertical reinforcing knit region, the sequence of m+n consecutive loops of any given course of the vertical reinforcing knit region being aligned with the sequence of m+n consecutive loops of any other course of the vertical reinforcing knit region.

In some embodiments, the at least one reinforcing knit region comprises at least one diagonal reinforcing knit region;

wherein for at least one set of two immediately adjacent courses of the diagonal reinforcing knit region, the sequence of m+n consecutive loops of a first course of the set of two immediately adjacent courses is offset from the sequence of m+n consecutive loops of a second course of the set of two immediately adjacent courses.

In some embodiments, the at least one diagonal reinforcing knit region comprises an S-oriented diagonal reinforcing knit region;

wherein the S-oriented diagonal reinforcing knit region comprises a plurality of sets of two immediately adjacent courses having the offset of the sequence of m+n consecutive loops of the first course and the second course of the two immediately adjacent courses; and wherein the offset of the sequence of m+n courses consecutive loops of the first course and the second course of each of the plurality of sets of two immediately adjacent courses is offset in a same leftwise direction.

In some embodiments, the at least one diagonal reinforcing knit region comprises a Z-oriented diagonal reinforcing knit region;

wherein the Z-oriented diagonal reinforcing knit region comprises a plurality of set of two immediately adjacent courses having the offset of the sequence of m+n consecutive loops of the first course and the second course of the two immediately adjacent courses; and wherein the offset of the sequence of m+n consecutive loops of the first course and the second course of each of the plurality of sets of two immediately adjacent courses is offset in a same rightwise direction.

In some embodiments, the at least one reinforcing knit region comprises at least one checkered reinforcing knit region;

wherein for at least one first set of two immediately adjacent courses of the diagonal reinforcing knit region, the sequence of m+n consecutive loops of a first course of the first set of two immediately adjacent courses is offset in a first direction from the sequence of m+n consecutive loops of a second course of the first set of two immediately adjacent courses; and wherein for at least one second set of two immediately adjacent courses of the diagonal reinforcing knit region, the sequence of m+n consecutive loops of a first course of the second set of two immediately adjacent courses is offset in a second direction, being opposite the first direction, from the sequence of m+n consecutive loops of a second course of the second set of two immediately adjacent courses.

In some embodiments, the clothing article further comprises at least one pinched region having a pinched stitch.

In some embodiments, the elasticity of the at least one base knit region is greater than an elasticity of the at least one reinforcing knit region.

In some embodiments, the UHMWPE fiber comprises a plurality of UHMWPE microfilaments.

In some embodiments, the clothing article is a breast support garment comprising a waistband;

wherein the at least one base knit region comprises:

a first breast region;

a second breast region;

an upper back region;

a first strap region extending from an upper edge of the first breast region to the upper back region;

a second strap region extending from an upper edge of the second breast region to the upper back region; and wherein the at least one reinforcing knit region comprises:

a first breast reinforcing region extending from a lower edge of the first breast region to an upper edge of the waistband;

a second breast reinforcing region extending from a lower edge of the second breast region to the upper edge of the waistband; and a central reinforcing region defined between the first and second breast regions and extending downwardly to the upper edge of the waistband.

In some embodiments, the at least one reinforcing knit region further comprises a back reinforcing region extending from a lower edge of the upper back region to the upper edge of the waistband.

In some embodiments, the at least one reinforcing knit region further comprises:

a first lateral reinforcing region extending between the first breast reinforcing region and the back reinforcing region and extending longitudinally between a lower edge defining a first armhole of the clothing article and the upper edge of the waistband; and a second lateral reinforcing region extending between the second breast reinforcing region and the back reinforcing region and extending longitudinally between a lower edge defining a second armhole of the clothing article and the upper edge of the waist band.

In some embodiments, the first breast reinforcing region, the second breast reinforcing region, the central breast reinforcing region, the back reinforcing region, the first lateral reinforcing region and the second lateral reinforcing region form a single contiguous reinforcing region.

In some embodiments, each of the reinforcing regions are vertical reinforcing knit regions, the sequence of m+n consecutive loops of any given course of the vertical reinforcing knit regions being aligned with the sequence of m+n consecutive loops of any other course of the vertical reinforcing knit regions.

In some embodiments, a support band for providing breast support is formed on the at least one reinforcing knit region.

In some embodiments, the support band is a single contiguous support band.

In some embodiments, the support band is configured to contour the underside of a wearer's breasts.

In some embodiments, the support band is W-shaped, extending from the first lateral reinforcing region, through the first breast reinforcing region, upwardly into the central reinforcing region, through the second breast reinforcing region and to the second lateral reinforcing region.

In some embodiments, the first and second ends of the support band extend upwardly towards the lower edges defining the first and second armholes, respectively.

In some embodiments, the support band is formed of cording.

In some embodiments, the breast support garment is a bra. In some embodiments, the bra is a bralette or a racerback bra. In some embodiments, the breast support garment is a tank.

In some embodiments, the tank is a crop top.

In some embodiments, the clothing article is an underpant comprising a waistband, a gusset, a first bottom end and a second bottom end, the first and second bottom ends defining a first leg hole and a second leg hole, respectively; wherein the at least one base knit region comprises a rear region of a rear portion of the clothing article.

In some embodiments, the rear region extends from a left side to a right side of the rear portion of the clothing article and from the waistband.

In some embodiments, the at least one reinforcing knit region comprises:

a vertical reinforcing region extending over a center sub-portion of a front portion of the clothing article;

a first S-oriented diagonal reinforcing knit region extending from a left side of the vertical reinforcing region; and/or a first Z-oriented diagonal reinforcing knit region extending from a right side of the vertical reinforcing region (and from the waistband to the bottom end of the clothing article).

In some embodiments, the at least one reinforcing knit region comprises:

a first S-oriented diagonal reinforcing knit region extending from a right side of a center portion of a front portion of the clothing article towards the rear portion of the clothing article or from a left side of the center portion of the front portion of the clothing article towards the rear portion of the clothing article; and/or a first Z-oriented diagonal reinforcing knit region extending from the left side of the center portion of the front portion of the clothing article or from the right side of the center portion of the front portion of the clothing article towards the rear portion of the clothing article.

In some embodiments, one or more of the reinforcing knit regions extends longitudinally from the waistband to the first or second bottom end of the clothing article. In some embodiments, the vertical reinforcing region extends from the waistband to the bottom end of the clothing article. In some embodiments, the first S-oriented diagonal reinforcing knit region extends from the waistband to the bottom end of the clothing article. In some embodiments, the first Z-oriented diagonal reinforcing knit region extends from the waistband to the bottom end of the clothing article.

In some embodiments, the vertical reinforcing region extends from the waistband to the gusset. In some embodiments, the first S-oriented diagonal reinforcing knit region extends from the waistband to the first or second bottom end of the clothing article. In some embodiments, the first Z-oriented diagonal reinforcing knit region extends from the waistband to the first or second bottom end of the clothing article.

In some embodiments, the at least one reinforcing knit region further comprises:

- a second Z-oriented diagonal reinforcing knit region extending from a left edge of the front portion of the clothing article to an outer edge of the first S-oriented diagonal reinforcing knit region extending from the left side of the center portion of the front portion of the clothing article;
- a first checkered reinforcing knit region extending between the S-oriented diagonal reinforcing knit region extending from the left side of the center portion of the front portion of the clothing article and the second Z-oriented diagonal reinforcing knit within the front portion of the clothing article;
- a second S-oriented diagonal reinforcing knit region extending from a right edge of the front portion of the clothing article to an outer edge of the first Z-oriented diagonal reinforcing knit region extending from the right side of the center portion of the front portion of the clothing article; and/or
- a second checkered reinforcing knit region extending between the first Z-oriented diagonal reinforcing knit region extending from the right side of the center portion of the front portion of the clothing article and the second S-oriented diagonal reinforcing knit within the front portion of the clothing article.

In some embodiments, the second Z-oriented diagonal reinforcing knit region extends longitudinally from an intermediate position between the waistband and the first bottom end of the clothing article to the first bottom end of the clothing article.

In some embodiments, the second S-oriented diagonal reinforcing knit region further extends longitudinally from an intermediate position between the waistband and the second bottom end of the clothing article to the second bottom end of the clothing article.

In some embodiments, the at least one reinforcing knit region further comprises:

- a third Z-oriented diagonal reinforcing knit region extending from a left edge of the rear portion of the clothing article; and/or
- a third S-oriented diagonal reinforcing knit region extending along a right edge of the rear portion of the clothing article.

In some embodiments, the third S-oriented diagonal reinforcing knit region extending from the right edge of the rear portion of the clothing article and the second Z-oriented diagonal reinforcing knit region extending from the left edge of the front portion of the clothing article are joined together to form a first chevron pattern.

In some embodiments, the third Z-oriented diagonal reinforcing knit region extending from the left edge of the rear portion of the clothing article and the second S-oriented diagonal reinforcing knit region extending from the right edge of the front portion of the clothing article are joined together to form a second chevron pattern.

In some embodiments, the at least one base knit region further comprises a front region.

In some embodiments, the at least one base knit region further comprises a first front base region extending longitudinally from an intermediate position between the waistband and the first bottom end of the front portion of the clothing article to the waistband, optionally extending laterally from the left side of the clothing article towards a center portion of the front portion of the clothing article.

In some embodiments, the at least one base knit region further comprises a second front base region extending longitudinally from an intermediate position between the waistband and the second bottom end of the clothing article to the waistband, optionally extending laterally from the right side of the front portion of the clothing article towards a center portion of the front portion of the clothing article.

In some embodiments, the underpant is a brief, optionally a hipster brief or a high-rise brief. In some embodiments, the underpant is a boyshort.

In some embodiments, the waistband is free of UHMWPE.

In some embodiments, the at least one base knit region has an apparent denier of 40 or less, 30 denier or less or 20 dernier or less.

In some embodiments, the at least one reinforcing knit region has an apparent denier of about 60 to about 120, about 70 to about 110 or about 80 to about 100.

In some embodiments, the stretch fiber comprises spandex, polypropylene, polyurethane, polyolefin, polyamide and polyester fibers, and combinations thereof.

In some embodiments, the base knit and/or the reinforcing knit further comprise one or more companion fiber.

BRIEF DESCRIPTION OF THE DRAWINGS

The present disclosure is best understood from the following detailed description when read in conjunction with the accompanying drawings. It is emphasized that, according to common practice, the various features of the drawings are not necessarily to scale. On the contrary, the dimensions and spatial relationship(s) of the various features may be arbitrarily enlarged or reduced for clarity. Like reference numerals denote like features throughout specification and drawings.

DETAILED DESCRIPTION

Figure 1:
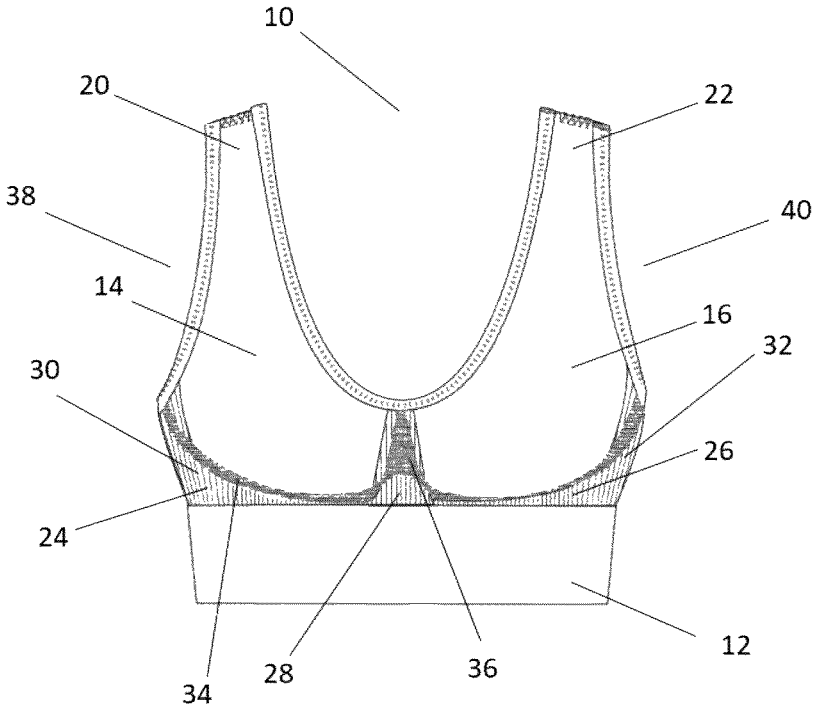
FIG. 1 is a front elevated view of a bralette, in accordance with some embodiments.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

In the following description, certain specific details are set forth in order to provide a thorough understanding of various embodiments. However, one skilled in the art will understand that the invention may be practiced without these details. In other instances, well-known structures have not been shown or described in detail to avoid unnecessarily obscuring descriptions of the embodiments. Unless the context requires otherwise, throughout the specification and claims which follow, the word "comprise" and variations thereof, such as, "comprises", "comprising", "includes" and "including" are to be construed in an open, inclusive sense, that is, as "including, but not limited to." Further, headings provided herein are for convenience only and do not interpret the scope or meaning of the claimed invention.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Also, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise. Further, as used in this specification and the appended claim, the term "about" has the meaning reasonably ascribed to it by a person of ordinary skill in the art when used in conjunction with a stated numerical value or range, i.e., denoting somewhat more or somewhat less than the stated value or range, to within a range of ±20% of the stated value; ±19% of the stated value; ±18% of the stated value; ±17% of the stated value; ±16% of the stated value; ±15% of the stated value; ±14% of the stated value; ±13% of the stated value; ±12% of the stated value; ±11% of the stated value; ±10% of the stated value; ±9% of the stated value; ±8% of the stated value; ±7% of the stated value; ±6% of the stated value; ±5% of the stated value; ±4% of the stated value; ±3% of the stated value; ±2% of the stated value; or ±1% of the stated value.

The term "UHMWPE" as used herein means ultra-high molecular weight polyethylene, also known as high-modulus polyethylene (HMPE) or high-performance polyethylene (HPPE).

The term "fiber" as used herein refers to a single origin base material made up of one or more filaments. It has an elongate body, the length dimension of which is much greater than the transverse dimensions of width and thickness.

The term "filament" as used herein refers to a single fibril of material that can be on its own a fiber or can be combined with other filaments to create a multifilament fiber. A single fiber may be formed from just one filament or from multiple filaments.

The term "microfilament" as used herein refers to a filament having a denier of 5 or less.

The term "denier" used herein refers to a unit of weight indicating the fineness of fiber filaments. It can be measured in mass in grams per 9,000 meters of fiber. A lower denier indicates a finer fiber and a higher denier indicates a thicker or heavier fiber.

The term "decitex (dtex)" as used herein refers to an alternate unit of weight indicating the fineness of fiber filaments. It can be measured in mass in grams per 10,000 meters.

The term "tensile strength" as used herein relates to the durability of the garment and is measured by the maximum stress that a material can withstand while being stretched or pulled before breaking. It is measured as force per unit area and can be expressed in units of gram force (gf) and centi-newton (CN) per dtex.

The term "elongation" as used herein refers to the stretch of individual fibers and composite fibers which results in the elasticity of the final embodiment of the present disclosure. Elongation is measured as a percentage of the starting length.

The term "natural fiber" as used herein refers to class of fibers obtainable from material of natural sources.

The term "synthetic fiber" as used herein is used to class of fibers delineate from the natural fibers. Synthetic fibers therefore comprise polymeric material, synthesized by polymerization of monomers, fibers obtained by regeneration of natural fibers, for instance after dissolution in a solvent, and glass fibers.

Term "stretch fiber" as used herein refers to class of fibers that, upon application of a force, is stretchable to a stretched at least about 130% of its original dimension without breaking. The stretch fiber includes without limitation spandex, polypropylene, polyamide, polyurethane, polyolefin and polyester fibers.

The term "high performance fiber" as used herein refers to class of fibers having high values of tenacity for example greater than 10 g/denier, such that they lend themselves for applications where high abrasion and/or cut resistance is important. Typically, high performance fibers have a high degree of molecular orientation and crystallinity in the final fiber structure.

The term "plating" or "plated" as used herein refers to a technique of knitting two fibers together in two distinct layers. Where one fiber stays in the back, behind the front fiber despite being knit in the same stitch.

The term "apparent denier" as used herein refers to the total denier of the visible fibers used in the knit, with clear fibers being considered non-apparent for the purposes of this application.

"Tensile properties" are properties measured when a material is subjected to stretching forces, and also the properties measured when the stretching forces are removed. Example tensile properties include but are not limited to tensile strength at break, percent elongation to break, modulus of elasticity, toughness or tensile energy to break, permanent set, tensile load at specified elongations, etc. Tensile properties of polymer fibers can be determined for example by standard test methods such as ASTM D2256/D2256M-21, "Tensile Properties of Yarns by the Single-Strand Method".

Accordingly, there is provided in the present disclosure a clothing article comprising UHMPE fibers. The clothing article comprises at least one base knit region and at least one reinforcing knit region. The at least one base knit region is formed of a base knit comprising an UHMWPE fiber and at least one base stretch fiber being knit together in a plated configuration to form a jersey knit. The at least one reinforcing knit region is formed of a reinforcing knit that comprises the UHMWPE fiber and the at least one base stretch fiber being knit together in a plated configuration to form a jersey knit. The reinforcing knit region further comprises a reinforcing stretch fiber that is alternatingly knit with the jersey knit of the reinforcing knit in which within each given course of the jersey knit of the reinforcing knit, for every sequence of m+n consecutive loops of the course, the reinforcing stretch fiber is looped with m consecutive loops of the jersey knit of the reinforcing knit and n consecutive loops of the jersey knit of the reinforcing knit (following the m consecutive loops) are free of looping with the reinforcing stretch fiber. The sequence of m+n consecutive loops are thereby repeated throughout the course.

In some embodiments, the at least one base knit region and the at least one reinforced knit region are integrally formed from a continuous knitting operation.

In some embodiments, m is equal to or greater than 1 and n is equal to or greater than 1.

In some embodiments, the reinforcing knit region comprises at least one vertical reinforcing knit region, the sequence of m+n consecutive loops of any given course of the vertical reinforcing knit region being aligned with the sequence of m+n consecutive loops of any other course of the vertical reinforcing knit region.

Figure 7:
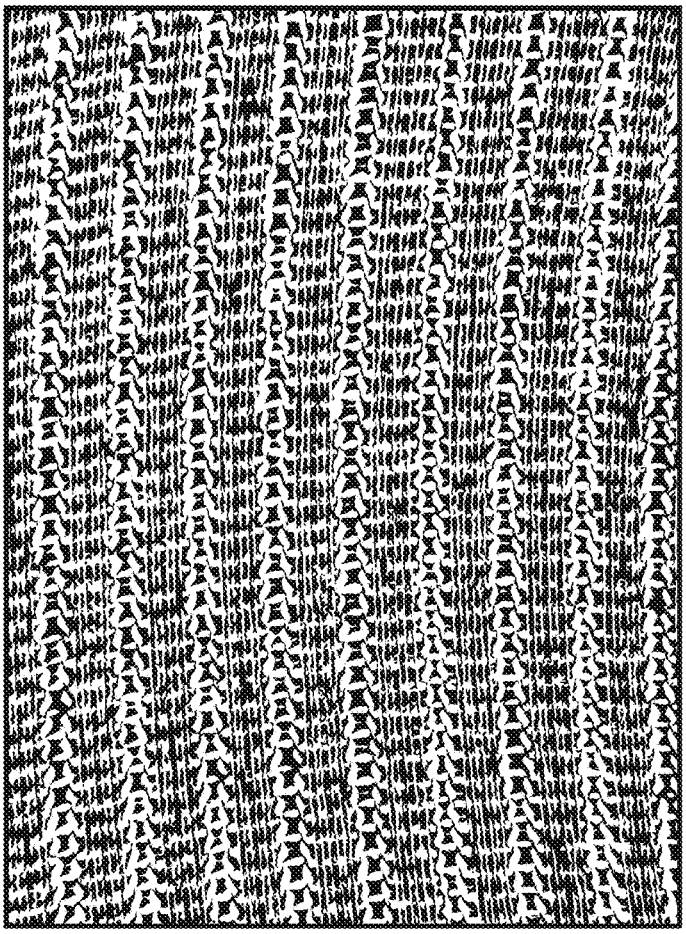
FIG. 7 is a photograph of a vertical reinforcing knit region, in accordance with some embodiments.
Figure 8:
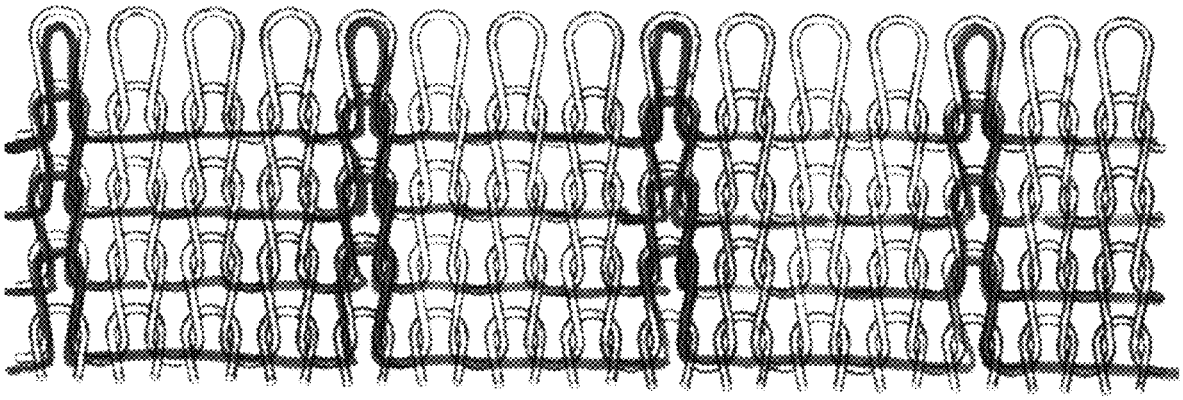
FIG. 8 is a schematic illustrating the knitting pattern of the vertical reinforcing knit region of FIG. 7, wherein the reinforcing stretch fiber is shown in dark grey.

Referring now to FIG. 7 and in particular to FIG. 8 (wherein the reinforcing stretch fiber is shown in dark grey), therein is a knit reinforcing region wherein m is equal to 1 and n is equal to 3. In this exemplary configuration, the reinforcing stretch fiber is looped with 1 consecutive loop of the jersey knit of the reinforcing knit and 3 consecutive loops of the jersey knit of the reinforcing knit are free of looping with such reinforcing stretch fiber. The alignment of the vertical reinforcing knit region provides the knit with a vertical ribbing appearance, as shown in FIGS. 7 and 8. The exemplary bralette shown in FIGS. 1 and 2 and the boyshort shown in FIG. 3 (and further described below) include portions which display vertical ribbing.

It will be understood that the appearance of the vertical ribbing pattern may be modified by varying the values of m and n loops. For example, a thicker ribbing motif may be achieved by increasing the value of m. The distance between the ribbing may also be modified by varying the value of n. For example, increasing the value of n will provide a wider ribbing pattern (i.e., greater distance between the ribbing) whereas decreasing the value of n will provide a narrower ribbing pattern.

In some embodiments, the reinforcing knit region comprises at least one diagonal reinforcing knit region, as shown for example in the boyshort of FIGS. 3 and 4 and the high-rise brief of FIGS. 5 and 6 (further described below). The diagonal pattern is a result of misalignment of subsequent given courses. In this configuration, for at least one set of two immediately adjacent courses, the sequence of m+n consecutive loops of a first course of the set of two immediately adjacent courses is offset from the sequence of m+n consecutive loops of a second course of the set of two immediately adjacent courses.

Figure 11:
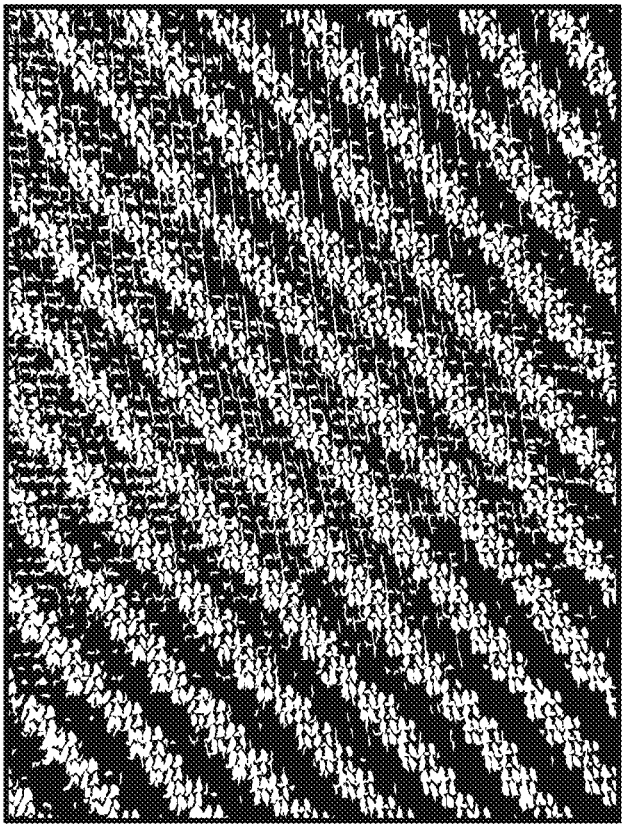
FIG. 11 is a photograph of a reinforcing knit region displaying a S-oriented diagonal reinforcing knit region, in accordance with some embodiments.
Figure 12:
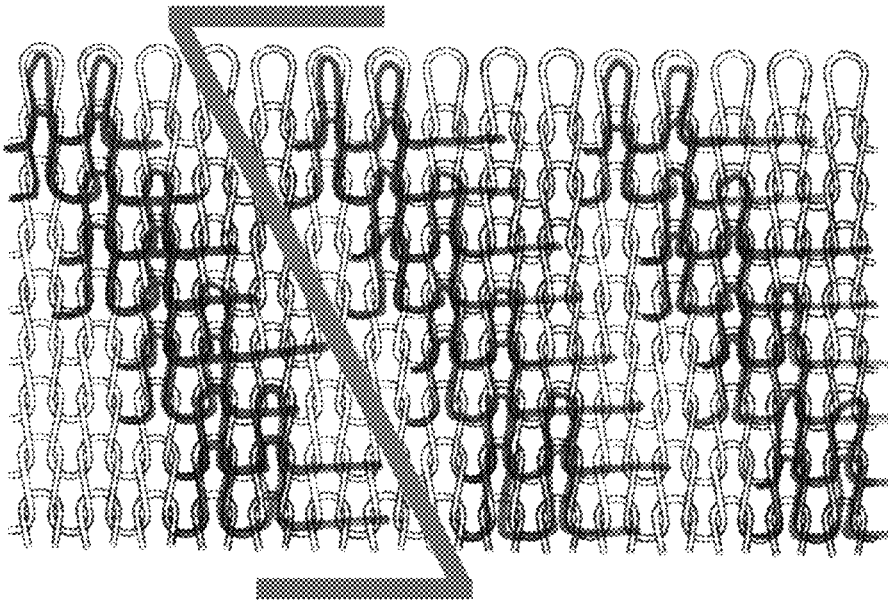
FIG. 12 is a schematic illustrating the knitting pattern of the S-oriented diagonal reinforcing knit region of the reinforcing knit region of FIG. 11, wherein the reinforcing stretch fiber is shown in dark grey and the letter "S" is included to show orientation.

Referring now to FIGS. 11 and 12, therein is a close-up view of an exemplary S-oriented diagonal reinforcing knit region. In an embodiment, the S-oriented diagonal reinforcing knit region comprises a plurality of sets of two immediately adjacent courses having the offset of the sequence of m+n consecutive loops of the first course and the second course of the two immediately adjacent courses. The offset of the sequence of m+n courses consecutive loops of the first course and the second course of each of the plurality of sets of two immediately adjacent courses is offset in a same leftwise direction, whereby the offsets across the courses of the S-oriented diagonal reinforcing knit region form at least one S-oriented diagonal rib.

As shown in FIGS. 11 and 12, m is equal to 2 and n is equal to 3. In this exemplary configuration, for each course, the reinforcing stretch fiber is looped with 2 consecutive loops of the jersey knit of the reinforcing knit and 3 consecutive loops of the jersey knit of the reinforcing knit are free of looping with such reinforcing stretch fiber. This is particularly will illustrated in FIG. 12 which shows the reinforcing stretch fiber in dark grey.

Figure 9:
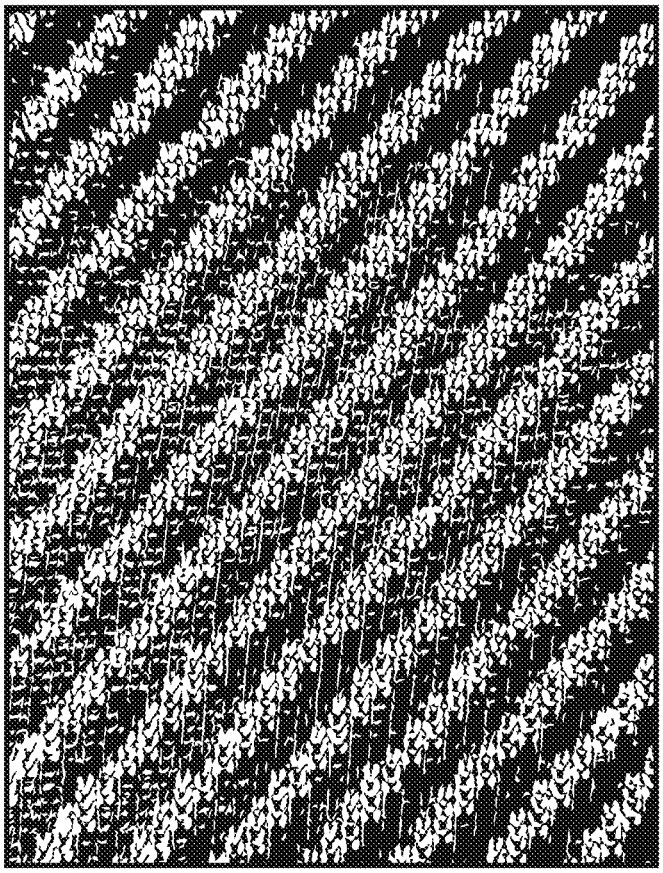
FIG. 9 is a photograph of a reinforcing knit region displaying a Z-oriented diagonal reinforcing knit region, in accordance with some embodiments.
Figure 10:
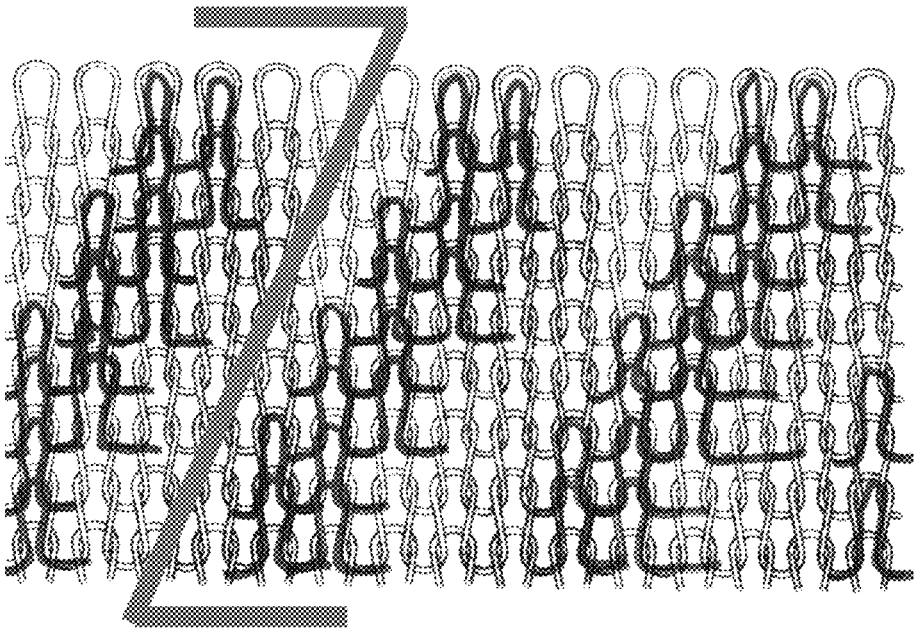
FIG. 10 is a schematic illustrating the knitting pattern of the Z-oriented diagonal reinforcing knit region of the reinforcing knit region of FIG. 9, wherein the reinforcing stretch fiber is shown in dark grey and the letter "Z" is included to show orientation.

With reference now to FIGS. 9 and 10, the clothing article can in some embodiments comprise at least one Z-oriented diagonal reinforcing knit region. In an embodiment, the Z-oriented diagonal reinforcing knit region comprises a plurality of sets of two immediately adjacent courses having the offset of the sequence of m+n consecutive loops of the first course and the second course of the two immediately adjacent courses. The offset of the sequence of m+n courses consecutive loops of the first course and the second course of each of the plurality of sets of two immediately adjacent courses is offset in a same rightwise direction, whereby the offsets across the courses of the Z-oriented diagonal reinforcing knit region form at least one Z-oriented diagonal rib.

As shown in FIGS. 9 and 10, m is equal to 2 and n is equal to 3. In this exemplary configuration, for each course, the reinforcing stretch fiber is looped with 2 consecutive loops of the jersey knit of the reinforcing knit and 3 consecutive loops of the jersey knit of the reinforcing knit are free of looping with such reinforcing stretch fiber. This is particularly will illustrated in FIG. 10 which shows the reinforcing stretch fiber in dark grey.

As will be readily understood, the appearance of the diagonal rib (whether in the Z- or S-orientation) may be modified by varying the values of m and n loops. For example, a thicker diagonal ribbing motif may be achieved by increasing the value of m. The distance between the ribbing may also be modified by varying the value of n. For example, increasing the value of n will provide a wider ribbing pattern (i.e., greater distance between the ribbing) whereas decreasing the value of n will provide a narrower ribbing pattern.

Figure 13:
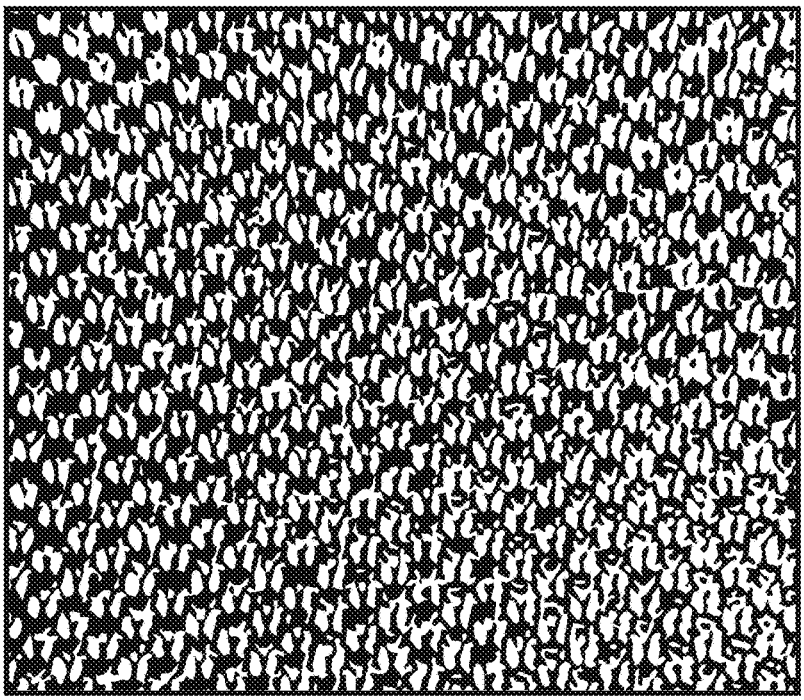
FIG. 13 is a photograph of a reinforcing knit region displaying a checkered reinforcing knit region, in accordance with some embodiments.

According to another embodiment as illustrated in FIGS. 11 and 12, the clothing article further comprises at least one checkered reinforcing knit region. FIG. 13 shows a close-up view of the knit pattern of the checkered reinforcing knit region.

Figure 14:
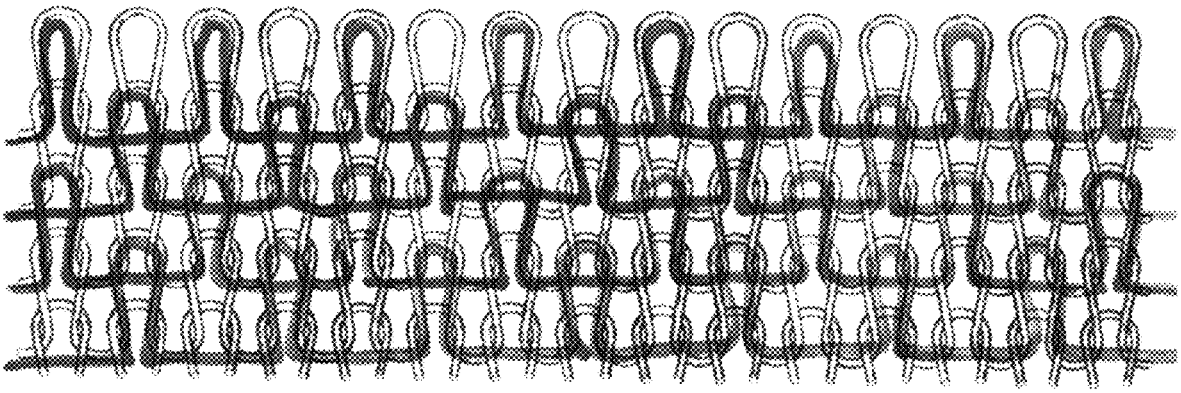
FIG. 14 is a schematic of a knit displaying a 1×1 offset knit, in accordance with some embodiments.

With particular reference to FIG. 14 (wherein the reinforcing stretch fiber is shown in dark grey), for at least one first set of two immediately adjacent courses of the diagonal reinforcing knit region, the sequence of m+n consecutive loops of a first course of the first set of two immediately adjacent courses is offset in a first direction from the sequence of m+n consecutive loops of a second course of the first set of two immediately adjacent courses; and wherein for at least one second set of two immediately adjacent courses of the diagonal reinforcing knit region, the sequence of m+n consecutive loops of a first course of the second set of two immediately adjacent courses is offset in a second direction, being opposite the first direction, from the sequence of m+n consecutive loops of a second course of the second set of two immediately adjacent courses.

As shown in FIGS. 13 and 14, m is equal to 1 and n is equal to 1. In this exemplary configuration, for each course, the reinforcing stretch fiber is looped with 1 consecutive loop of the jersey knit of the reinforcing knit and 1 consecutive loops of the jersey knit of the reinforcing knit is free of looping with such reinforcing stretch fiber.

In some embodiments, the clothing article may have at least one pinched region having a pinched stitch. Referring now to FIG. 1, the breast support garment includes a pinched region having a pinched stitch. The pinched region provides a ruching effect which helps define separate cups for receiving breasts, thus preventing the appearance of a mono-boob.

Figure 2:
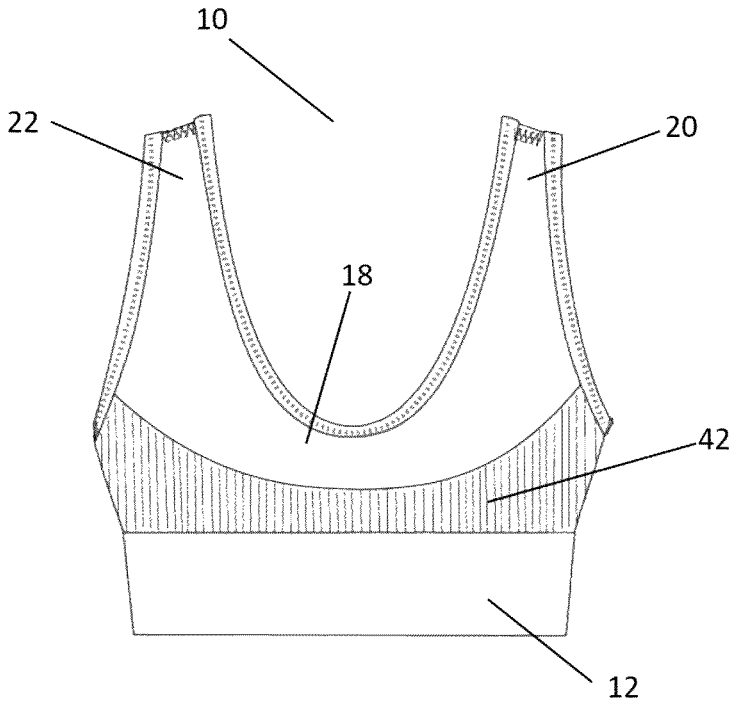
FIG. 2 is a back elevated view of the bralette of FIG. 1.

In an aspect, the present disclosure relates to an undergarment article. Referring now to FIGS. 1 and 2, an exemplary breast support garment 10 is provided. The breast support garment 10 comprises a waistband 12, a first breast region 14, a second breast region 16, an upper back region 18, and first 20 and second 22 strap regions. The first strap region 20 extends from an upper edge of the first breast region 14 to the upper back region 18. The second strap region 22 extends from an upper edge of the second breast region 16 to the upper back region 18. The exemplary bralette comprises a plurality of reinforcing knit regions. The first breast reinforcing region 24 extends from a lower edge of the first breast region 14 to an upper edge of the waistband 12. The second breast reinforcing region 26 extends from a lower edge of the second breast region 16 to the upper edge of the waistband 12. A central reinforcing region 28 is defined between the first and second breast regions 14, 16 and extending downwardly to the upper edge of the waistband 12. In this particular example, the reinforcing knit region extends all around the back portion of the bralette, forming a back reinforcing region 42 which extends from a lower edge of the upper back region 18 to the upper edge of the waistband 12. As can be seen in FIG. 1, the at least one reinforcing knit region further comprises a first lateral reinforcing region 30 which extends between the first breast reinforcing region 24 and the back reinforcing region 42 and extends longitudinally between a lower edge defining a first armhole 38 of the clothing article 10 and the upper edge of the waistband 12. Similarly, a second lateral reinforcing region 32 extends between the second breast reinforcing region 26 and the back reinforcing region 42 and extends longitudinally between a lower edge defining a second armhole 40 of the clothing article 10 and the upper edge of the waist band 12.

In some embodiments, the reinforcing knit regions are separated for example between sections of base knit region (s). In other embodiments, as illustrated in FIGS. 1 and 2, the first breast reinforcing region 24, the second breast reinforcing region 26, the central breast reinforcing region 28, the back reinforcing region 42, the first lateral reinforcing region 30 and the second lateral reinforcing region 32 form a single contiguous reinforcing region. Each of the reinforcing regions of the bralette of FIGS. 1 and 2 are vertical reinforcing knit regions and have the sequence of m+n consecutive loops of any given course of the vertical reinforcing knit regions being aligned with the sequence of m+n consecutive loops of any other course of the vertical reinforcing knit regions.

In some embodiments, an additional support band is included on or near the vertical reinforcing knit region to provide additional breast support. Referring still to FIG. 1, therein is provided a support band 34 that is formed on the at least one reinforcing knit region. The support band can be a single contiguous support band or can be composed of a smaller support band segments included where breast support is most desirable, for example underneath the breasts and on the outer side of each breast. For example, the support band is configured to contour the underside of a wearer's breasts. In some embodiments, and as shown in FIG. 1, the support band is W-shaped, extending from the first lateral reinforcing region 30, through the first breast reinforcing region 34, upwardly into the central reinforcing region 28, through the second breast reinforcing region 26 and to the second lateral reinforcing region 32. The first and second ends of the support band 34 extend upwardly towards the lower edges defining the first and second armholes 38, 40, respectively. In some embodiments, the support band is included on the vertical reinforcing knit regions. In other embodiments, the support band is included at an edge delineating the reinforcing knit regions and the base regions.

The support band 34 can in some embodiments be made of cording or other knit that provides increases rigidity compared to the base knit regions and reinforcing knit regions, thereby providing the breast support (similarly to a traditional bra underwire).

The breast support garment shown in FIGS. 1 and 2 is a bralette, however other breast support garments are contemplated, including without limitation, racerbacks, tanks, crop tops, etc.

Figure 15:
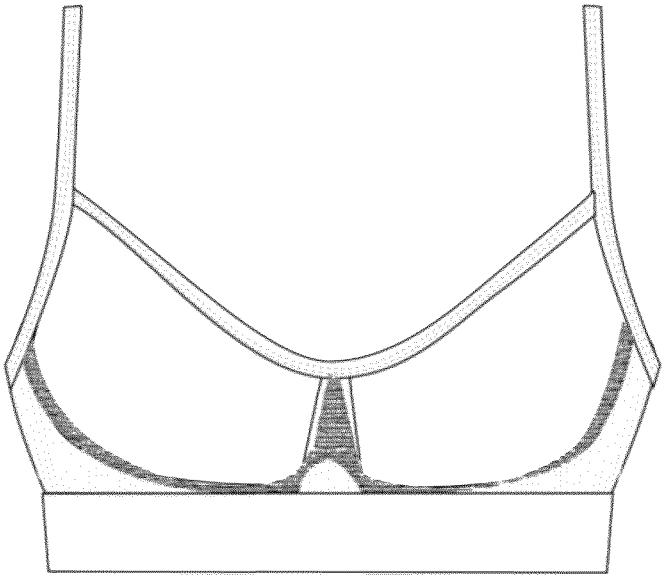
FIG. 15 is a front elevated view of a racerback bra, in accordance with some embodiments.
Figure 16:
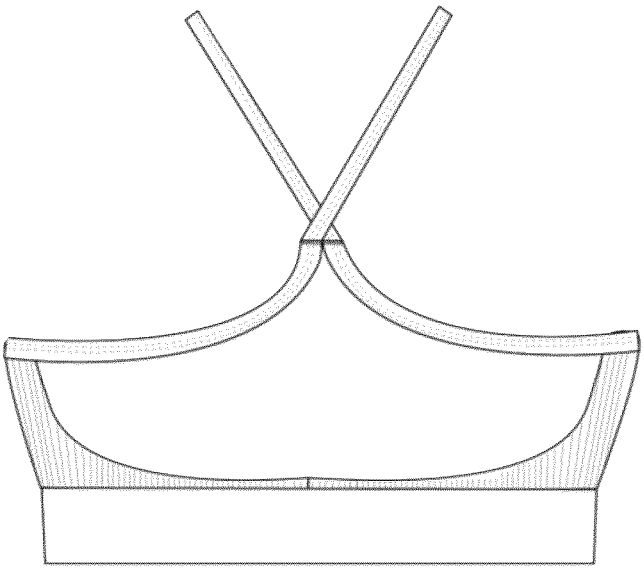
FIG. 16 is a back elevated view of the racerback bra of FIG. 15.

In some embodiments, the breast support garment is a racerback, as shown in FIGS. 15 and 16. As can be seen, the exemplary racerback is similar to the bralette of FIGS. 1 and 2 aside from its straps being thinner and crossing over on the back end.

In another aspect, the present disclosure relates to an underpant (or underwear bottom). With reference now to FIGS. 3 and 4, the boyshort (or shorty) underpant 50 comprises a waistband 52, a gusset 54, a first bottom end 56 and a second bottom end 58. The first and second bottom ends define a first leg hole and a second leg hole, respectively. The at least one base knit region comprises a rear region of a rear portion 60 of the boyshort 50. In some embodiments, the rear region extends from a left side to a right side of the rear portion 60 and longitudinally from the waistband 52 to the bottom ends 56, 58 and the gusset 54.

Figure 3:
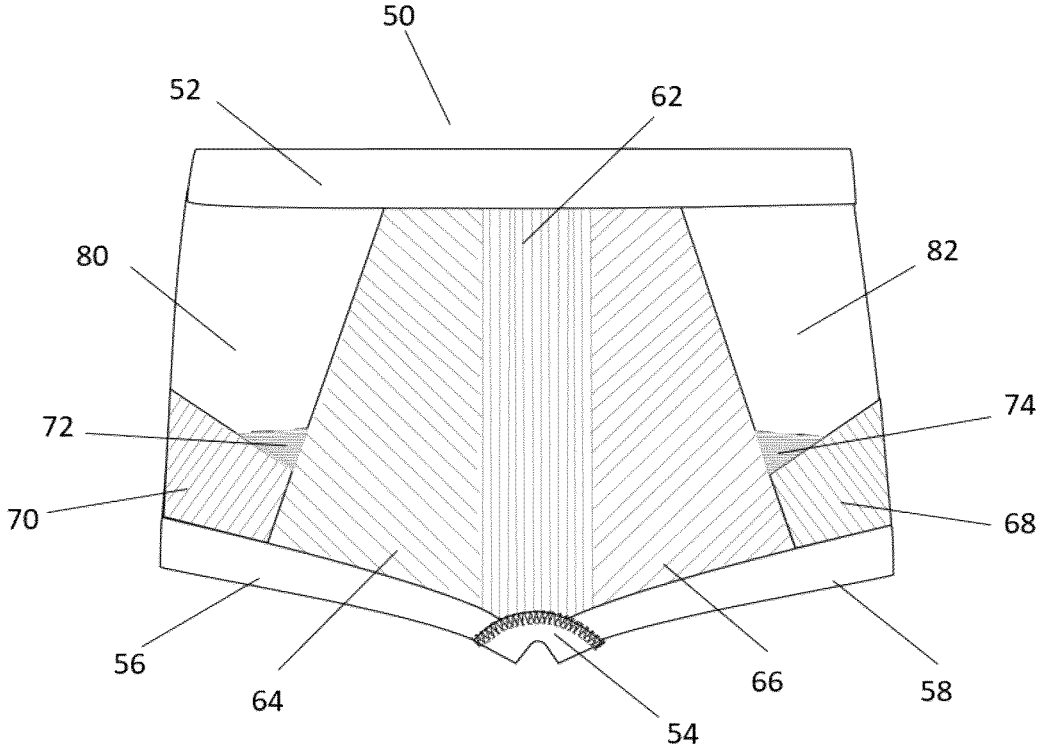
FIG. 3 is a front elevated view of a boyshort, in accordance with some embodiments.
Figure 4:
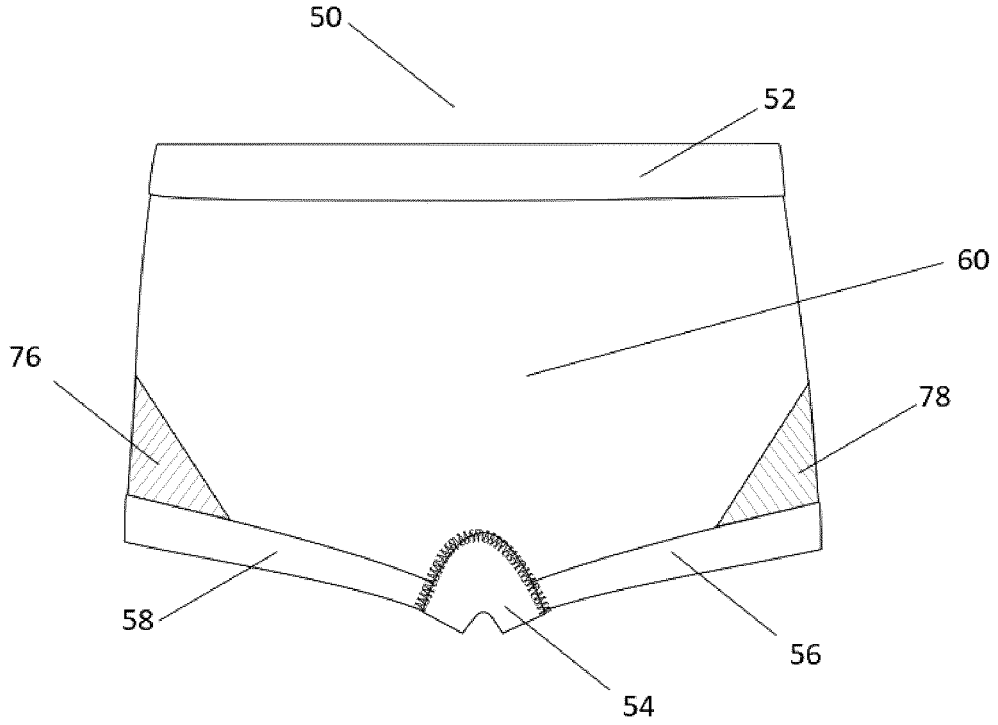
FIG. 4 is a back elevated view of the boyshort of FIG. 3.

Still referring to FIGS. 3 and 4, the boyshort 50 has a vertical reinforcing region 62 extending over a center subportion of a front portion of the boyshort 50. The front portion of the boyshort 50 further has a first S-oriented diagonal reinforcing knit region 64 extending from a left side of the vertical reinforcing region 62; a first Z-oriented diagonal reinforcing knit region 66 extending from a right side of the vertical reinforcing region 62.

In some embodiments, the one or more of the reinforcing knit regions extends longitudinally from the waistband to the first or second bottom end or gusset of the clothing article.

As shown in FIG. 3, the vertical reinforcing region 62 extends from the waistband 52 to the gusset 54.

In other embodiments, the clothing article is free of a vertical reinforcing region and rather comprises one or more diagonal reinforcing knit regions. Referring to FIGS. 5 and 6, therein is a high-rise brief 90 comprising a waistband 92, a gusset 94 as well as first and second bottom ends defining a first leg hole and a second leg hole, respectively. The brief 90 includes two reinforcing knit regions, namely a first S-oriented diagonal reinforcing knit region 98 extending from a right side of a center portion of a front portion of the brief 90 towards the rear portion of the brief 90, and a first Z-oriented diagonal reinforcing knit region 96 extending from the left side of the center portion of the front portion of the brief 90 towards the rear portion of the brief 90.

In other embodiments (not illustrated), the underpant may include a first S-oriented diagonal reinforcing knit region extending from a left side of the center portion of the front portion of the clothing article towards the rear portion of the clothing article; and/or a first Z-oriented diagonal reinforcing knit region extending from the right side of the center portion of the front portion of the clothing article towards the rear portion of the clothing article.

Figure 5:
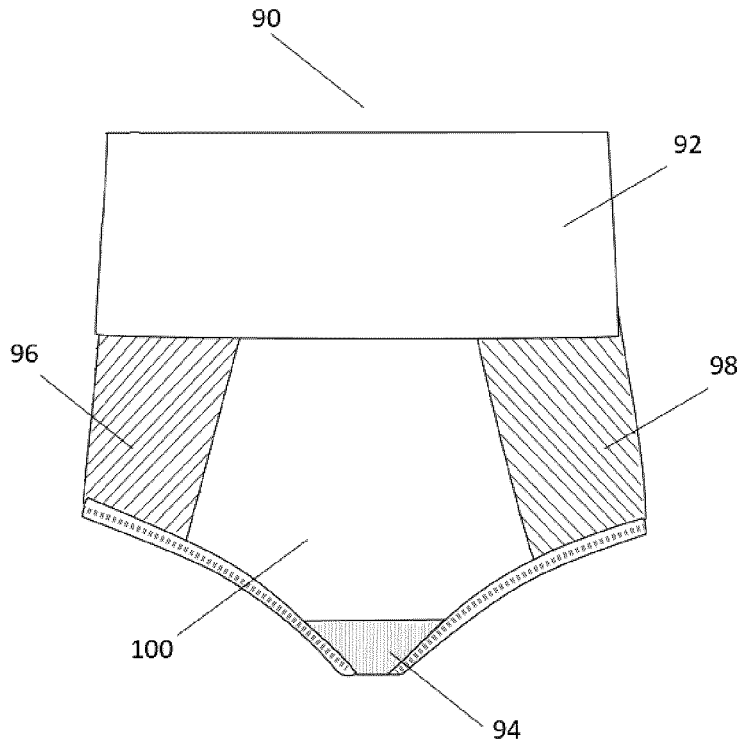
FIG. 5 is a front elevated view of a high-rise brief, in accordance with some embodiments.

The first S-and/or Z-oriented diagonal reinforcing knit regions can also extend from the waist band to the to the first or second bottom end of the clothing article, as shown in FIGS. 3 and 5.

In some embodiments, the clothing article further comprises a second Z-oriented diagonal reinforcing knit region extending from a left edge of the front portion of the clothing article to an outer edge of the first S-oriented diagonal reinforcing knit region extending from the left side of the center portion of the front portion of the clothing article; a first checkered reinforcing knit region extending between the S-oriented diagonal reinforcing knit region extending from the left side of the center portion of the front portion of the clothing article and the second Z-oriented diagonal reinforcing knit within the front portion of the clothing article; a second S-oriented diagonal reinforcing knit region extending from a right edge of the front portion of the clothing article to an outer edge of the first Z-oriented diagonal reinforcing knit region extending from the right side of the center portion of the front portion of the clothing article; and/or a second checkered reinforcing knit region extending between the first Z-oriented diagonal reinforcing knit region extending from the right side of the center portion of the front portion of the clothing article and the second S-oriented diagonal reinforcing knit within the front portion of the clothing article.

Referring back to FIG. 3, the boyshort 50 further comprises a second Z-oriented diagonal reinforcing knit region 70 extending from a left edge of the front portion of the boyshort 50 to an outer edge of the first S-oriented diagonal reinforcing knit region 64 extending from the left side of the center portion of the front portion of the boyshort 50; a first checkered reinforcing knit region 72 extending between the first S-oriented diagonal reinforcing knit region 64 extending from the left side of the center portion of the front portion of the boyshort 50 and the second Z-oriented diagonal reinforcing knit region 70 within the front portion of the boyshort 50; a second S-oriented diagonal reinforcing knit region 68 extending from a right edge of the front portion of the boyshort 50 to an outer edge of the first Z-oriented diagonal reinforcing knit region 66 extending from the right side of the center portion of the front portion of the boyshort 50; and a second checkered reinforcing knit region 74 extending between the first Z-oriented diagonal reinforcing knit region 66 extending from the right side of the center portion of the front portion of the boyshort 50 and the second S-oriented diagonal reinforcing knit 68 within the front portion of the boyshort 50.

In some embodiments, the second Z-oriented diagonal reinforcing knit region extends longitudinally from an intermediate position between the waistband and the first bottom end of the clothing article to the first bottom end of the clothing article. In other embodiments, the second S-oriented diagonal reinforcing knit region further extends longitudinally from an intermediate position between the waistband and the second bottom end of the clothing article to the second bottom end of the clothing article.

Still referring to FIG. 3, the second Z-oriented diagonal reinforcing knit region 70 extends longitudinally from an intermediate position between the waistband 52 and the first bottom end 56 of the boyshort 50 to the first bottom end 56; and the second S-oriented diagonal reinforcing knit region 68 further extends longitudinally from an intermediate position between the waistband 52 and the second bottom end 58 of the boyshort 50 to the second bottom end 58.

The rear portion of the underpant may comprise one or more diagonal reinforcing knit regions. According to an example embodiment, the boyshort 50 of FIG. 4 further comprises a third Z-oriented diagonal reinforcing knit region 76 extending from a left edge of the rear portion 60; and a third S-oriented diagonal reinforcing knit region 78 extending along a right edge of the rear portion 60 of the boyshort 50.

Figure 6:
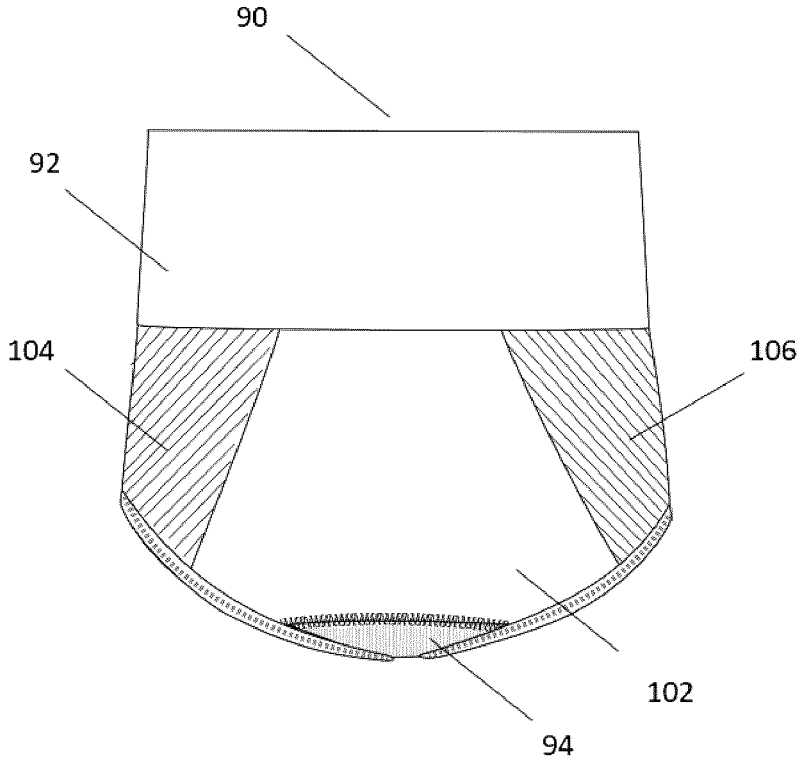
FIG. 6 is a back elevated view of the high-rise brief of FIG. 5.

Similarly, with reference to FIG. 6, the high-rise brief 90 comprises a Z-oriented diagonal reinforcing knit region 104 extending from a left edge of the rear portion 102; and an S-oriented diagonal reinforcing knit region 106 extending along a right edge of the rear portion of the brief 90.

In some embodiments, the rear diagonal reinforcing knit regions extend longitudinally from the waistband to the bottom ends (as shown in FIG. 5.). In other embodiments, the rear diagonal reinforcing knit regions extend from the bottom ends towards an intermediate between the waistband and the bottom ends (as shown in FIG. 4).

According to some examples, a front diagonal reinforcing knit region may be joined to a rear diagonal reinforcing knit region so as to form a chevron pattern. It has been found that such chevron pattern on both sides of the underpant provides desired aesthetic characteristics and an increased smoothing profile. In addition, the chevron pattern and triangular shape (an apex of the triangle being located at the edge between the front and rear portions of the underpant) provide additional rigidity to the sides, thereby reducing lateral riding up of the underpant when worn by the wearer.

The front portion of the underpant may include one or more regions that are made of the base knit. For example, referring to FIG. 3, the front portion of the boyshort 50 comprises a first front base region 80 extending longitudinally from an intermediate position between the waistband 52 and the first bottom end 56 of the front portion of the boyshort 50 to the waistband 52, and extending laterally from the left side of the boyshort 50 towards a center portion of the front portion of the boyshort 50. Similarly, the boyshort 50 comprises a second front base region 82 extending longitudinally from an intermediate position between the waistband 52 and the second bottom end 58 of the boyshort 50 to the waistband 52, extending laterally from the right side of the front portion of the boyshort 50 towards a center portion of the front portion of the boyshort 50.

In other embodiments, the underpant comprises a front portion with a single region made of the base knit. As shown in FIG. 5, the brief 90 comprises a front base region 100 extending longitudinally from the waistband 92 to the bottom end of the brief 90.

As is illustrated, the underpant of FIGS. 3 and 4 is a boyshort (or shorty) and the underpant of FIGS. 5 and 6 is a high-rise brief. It will be understood that other types of underpants or underwear are also contemplated, including without limitation, bikini briefs, hipsters, shorts, etc.

In some embodiments, the underpant further comprises on its rear portion a support band to provide buttock support and lift. The support band is configured to contour the underside of the wearer's buttock.

Also provided here in an aspect is a clothing article that comprises one or more regions having a sheer or semi-sheer appearance.

For example, referring to the bralette of FIGS. 1 and 2, the first and second breast regions 14, 16, the first and second strap regions 20, 22 and the upper back region may have a sheer or semi-sheer appearance. For example, referring to the boyshort of FIGS. 3 and 4, the front base regions 80 and 82 and the rear portion 60 may have a sheer or semi-sheer appearance. Now referring to the brief of FIGS. 5 and 6, the front portion 100 and the rear portion 102 may have a sheer or semi-sheer appearance. The waistband may similarly have a sheer or semi-sheer appearance. In some embodiments, the clothing article is a fitness garment such as a legging and has sheer or semi-sheer portions. For example, the clothing article may further comprise reinforcing knit regions configured to provide localized compression where desired.

In some embodiments, the waistband comprises UHMWPE fiber. In other embodiments, the waistband is free of UHMWPE fiber.

In an embodiment, the at least one base knit region has an apparent denier that is lower than that of the reinforcing knit region.

For example, the at least one base knit region has an apparent denier from about 1 to about 60. For example, the at least one base knit region has an apparent denier from about 1 to about 50. For example, the at least one base knit region has an apparent denier from about to about 60. For example, the at least one base knit region has an apparent denier from about to about 60. For example, the at least one base knit region has an apparent denier from about 10 to about 50. For example, the at least one base knit region has an apparent denier from about to about 45. For example, the at least one base knit region has an apparent denier from about 15 to about 40. For example, the at least one base knit region has an apparent denier from about 15 to about 35. For example, the at least one base knit region has an apparent denier from about 15 to 30. For example, the at least one base knit region has an apparent denier from about 20 to about 45. For example, the at least one base knit region has an apparent denier from about 20 to about 40. For example, the at least one base knit region has an apparent denier from about 20 to about 35. For example, the at least one base knit region has an apparent denier from about 20to about 30. For example, the at least one base knit region has an apparent denier from about 25 to about 45. For example, the at least one base knit region has an apparent denier from about 25 to about 40. For example, the at least one base knit region has an apparent denier from about 25 to about 35. For example, the at least one base knit region has an apparent denier from about 5. For example, the at least one base knit region has an apparent denier from about 10. For example, the at least one base knit region has an apparent denier from about 15. For example, the at least one base knit region has an apparent denier from about 20. For example, the at least one base knit region has an apparent denier from about 25. For example, the at least one base knit region has an apparent denier from about 30. For example, the at least one base knit region has an apparent denier from about 35. For example, the at least one base knit region has an apparent denier from about 40. For example, the at least one base knit region has an apparent denier from about 45. For example, the at least one base knit region has an apparent denier from about 50. For example, the at least one base knit region has an apparent denier from about 55. For example, the at least one base knit region has an apparent denier from about 60. For example, the at least one base knit region has an apparent denier from about 65. For example, the at least one base knit region has an apparent denier from about 70. For example, the at least one base knit region has an apparent denier from about 75.

For example, the at least one reinforcing knit region has an apparent denier of about 60 to about 300. For example, the at least one reinforcing knit region has an apparent denier of about 60 to about 250. For example, the at least one reinforcing knit region has an apparent denier of about 60 to about 200. For example, the at least one reinforcing knit region has an apparent denier of about 60 to about 150. For example, the at least one reinforcing knit region has an apparent denier of about 60 to about 140. For example, the at least one reinforcing knit region has an apparent denier of about 60 to about 130. For example, the at least one reinforcing knit region has an apparent denier of about 60 to about 120. For example, the at least one reinforcing knit region has an apparent denier of about 60 to about 120. For example, the at least one reinforcing knit region has an apparent denier of about 60 to about 110. For example, the at least one reinforcing knit region has an apparent denier of about 60 to about 100. For example, the at least one reinforcing knit region has an apparent denier of about 70 to about 110. For example, the at least one reinforcing knit region has an apparent denier of about 75 to about 105. For example, the at least one reinforcing knit region has an apparent denier of about 80 to about 100. For example, the at least one reinforcing knit region has an apparent denier of about 60. For example, the at least one reinforcing knit region has an apparent denier of about 70. For example, the at least one reinforcing knit region has an apparent denier of about 80. For example, the at least one reinforcing knit region has an apparent denier of about 90. For example, the at least one reinforcing knit region has an apparent denier of about 100. For example, the at least one reinforcing knit region has an apparent denier of about 110. For example, the at least one reinforcing knit region has an apparent denier of about 120. For example, the at least one reinforcing knit region has an apparent denier of about 130. For example, the at least one reinforcing knit region has an apparent denier of about 140. For example, the at least one reinforcing knit region has an apparent denier of about 150. For example, the at least one reinforcing knit region has an apparent denier of about 160. For example, the at least one reinforcing knit region has an apparent denier of about 170. For example, the at least one reinforcing knit region has an apparent denier of about 180. For example, the at least one reinforcing knit region has an apparent denier of about 190. For example, the at least one reinforcing knit region has an apparent denier of about 200.

In an embodiment, an elasticity of the at least one base knit region is greater than an elasticity of the at least one reinforcing knit region.

In one embodiment, the UHMWPE fiber comprises a plurality of UHMWPE microfilaments.

In some embodiments, the UHMWPE microfilaments are untwisted. In other embodiments, the UHMWPE microfilaments are twisted together, optionally with a twist per inch (TPI) between 1 to 30, between 4 and 25, between 6 and 20, or between 8 and 16, or any number therebetween.

In an embodiment, the base knit and/or the reinforcing knit further comprise one or more companion fiber.

In some embodiments, the UHMWPE fibers of the present disclosure may be prepared according to methods described for example in United States Patent Publication No. 20222256620, incorporated herein by reference in its entirety.

In some embodiments, the UHMWPE fiber has high impact strength, low density, low elongation at break, resistance to corrosive chemicals, low moisture absorption, and/or low coefficient of friction. In other embodiments, the material is self-lubricating and/or highly resistant to abrasion and odor.

In some embodiments, the UHMWPE fiber has a weight average molecular weight ($M_w$) of at least about 200,000. In some embodiments, the UHMWPE fiber has a weight average molecular weight ($M_w$) ranging from about 300,000 to about 7,000, 000, from about 700,000 to about 5,000,000, or from about 900,000 to about 4,000,000. A molecular weight distribution of the UHMWPE fiber, that is the ratio of the weight average molecular weight ($M_w$) to a number average molecular weight ($M_n$) of the UHMWPE fiber, is of about 5.0 or less, about 4.0 or less, or about 3.0 or less.

In some embodiments, the UHMWPE fiber comprises a monofilament. In some other embodiments, the UHMWPE fiber comprises a plurality of microfilaments. In some embodiments, each of the microfilaments in the UHMWPE has a denier of about 5 of less, about 4 or less, about 3 or less, about 2.5 or less, about 2 or less, about 1.5 or less, about 1 or less, or about 0.5 or less.

The UHMWPE fiber may include any suitable number of microfilaments. In some embodiments, the UHMWPE fiber comprises 2 to 400 microfilaments, 10 to 300 microfilaments, or 20 to 200 microfilaments. In some embodiments, the UHMWPE fiber comprises 10 to 50 microfilaments. In some embodiments, the UHMWPE fiber comprises 5 to 50 microfilaments. In some embodiments, the UHMWPE fiber comprises 5 to 25 microfilaments. In some embodiments, the UHMWPE fiber comprises 5, 7, 10, 15, 20, 25, 30, 35, 40, 45, or 50 microfilaments or any number therebetween.

The UHMWPE fiber may be of any suitable denier. In some embodiments, the UHMWPE fiber has a denier ranging from about 5 to about 150. In some embodiments, the UHMWPE fiber has a denier ranging from about 10 to about 60. In some embodiments, the UHMWPE fiber has a denier of about 10, about 15, about 20, about 25, about 30, about 40, about 50, about 60, about 70, about 75, about 80, about 90, about 100, about 110, about 120, about 125, about 130, about 140, about 150. In some embodiments, the UHMWPE fiber has a denier of 50 or less.

In some embodiments, the UHMWPE fiber is a high strength fiber. In some embodiments, the UHMWPE fiber has a tensile strength (i.e., tenacity) of at least 20 cN/dtex, at least 25 cN/dtex, at least about 30 cN/dtex, at least about 35 cN/dtex, at least about 40 cN/dtex, at least about 45 cN/dtex, at least about 50 cN/dtex, at least about 55 cN/dtex, or at least about 60 cN/dtex. In some embodiments, the UHMWPE fiber has a tensile strength of about 26 cN/dtex, about 28 cN/dtex, about 30 cN/dtex, about 32 cN/dtex, about 36 cN/dtex, about 40 cN/dtex, about 45 cN/dtex, or about 50 cN/dtex.

In some embodiments, the UHMWPE fiber has a modulus of about 1000 cN/dtex or greater, about 1100 cN/dtex or greater about 1200 cN/dtex or greater, about 1300 cN/dtex or greater, about 1400 cN/dtex or greater, about 1500 cN/dtex or greater, about 1600 cN/dtex or greater. In some embodiments, the UHMWPE fiber has a modulus of about 1400 cN/dtex, about 1420 cN/dtex, about 1450 cN/dtex, about 1500 cN/dtex, or about 1360 cN/dtex.

In some embodiments, the UHMWPE fiber allows an elongation of no more than about 10%, no more than about 8%, no more than about 5%, no more than about 4%, no more than about 3.5%, no more than about 3%, no more than about 2.5%, no more than about 2%, or no more than about 1.5%.

In some embodiments, the UHMWPE fiber has a breaking force of about 10 N or greater, about 11 N or greater, about 12 N or greater, about 13 N or greater, about 14 N or greater, about 15 N or greater, about 16 N or greater, about 18N or greater, or about 20 N or greater.

In some embodiments, the UHMWPE fiber has a breaking work of at least about 100 N·mm, at least about 110 N·mm, at least about 120 N·mm, at least about 130 N·mm, at least about 140 N·mm, at least about 150 N·mm, at least about 160 N·mm, or at least about 170 N·mm.

In some embodiments, the UHMWPE fiber is a colored UHMWPE fiber comprising a dye. In some embodiments, the dye has a color selected from black, blue, grey, red, blue, brown, yellow, green, orange, and nude.

In some embodiments, the UHMWPE fiber comprises multiple microfilaments which are not twisted (i.e., untwisted microfilaments).

In some other embodiments, to keep the filaments together and to increase strength and reduce pilling, the UHMWPE fiber is twisted. To maintain the strength, the twists per inch (TPI) should not be too high. In some embodiments, the UHMWPE fiber has a twists per inch (TPI) between 1 to 30, between 4 and 25, between 6 and 20, or between 8 and 16. In some embodiments, the UHMWPE fiber has a TPI of 1. In some embodiments, the UHMWPE fiber has a TPI of 2. In some embodiments, the UHMWPE fiber has a TPI of 3. In some embodiments, the UHMWPE fiber has a TPI of 4. In some embodiments, the UHMWPE fiber has a TPI of 5. In some embodiments, the UHMWPE fiber has a TPI of 6. In some embodiments, the UHMWPE fiber has a TPI of 8. In some embodiments, the UHMWPE fiber has a TPI of 10. In some embodiments, the UHMWPE fiber has a TPI of 12. In some embodiments, the UHMWPE fiber has a TPI of 15. In some embodiments, the UHMWPE fiber has a TPI of 16. In some embodiments, the UHMWPE fiber has a TPI of 18. In some embodiments, the UHMWPE fiber has a TPI of 20. In some embodiments, the UHMWPE fiber has a TPI of 25. In some embodiments, the UHMWPE fiber has a TPI of 30.

In various aspects, the UHMWPE fibers described herein can be produced according to methods described in U.S. publication no. US20220056620, which is incorporated herein by reference in its entirety.

The clothing articles of the present disclosure have desirable characteristics, including softness, hydrophobicity, surface lubricity, abrasion resistance, ripping resistance, improved drape, pilling resistance, and antimicrobial properties.

The knit of the present disclosure has improved cut and abrasion resistance properties and provides a cooling effect on the wearers.

In some embodiments, the knit comprises a UHMWPE fiber, a stretch fiber and a companion fiber. Unless specified otherwise, reference herein to "the knit" includes reference to one or more of the at least one base knit regions and/or one or more of the at least one reinforcing knit regions.

In an embodiment, the stretch fiber comprises without limitation spandex, polypropylene, polyamide, polyurethane, polyolefin and polyester fibers and combinations thereof. In some embodiments, the stretch fiber has an elongation of about 130% or greater, about 200% or greater, about 300% or greater, or about 400% or greater.

The UHMWPE fiber can be any of UHMWPE fibers described herein. In some embodiments, the UHMWPE fiber includes multiple microfilaments, each of the microfilaments having a denier of 5 or less. In some embodiments, the UHMWPE fiber is a colored fiber comprising a dye. In some embodiments, the UHMWPE fiber has a variation of the color along the length of said UHMWPE fiber. In some embodiments, a variation of the color along the length of the UHMWPE fiber is less than ±2.5%, less than ±3%, less than ±3.5%, less than ±4%, less than ±5%, less than ±6%, less than ±7%, less than ±8%, or less than ±9%, or less than ±10%.

The use of UHMWPE fiber provides benefits to knit such as cooling effect, light weight, moisture wicking, and antimicrobial. The antimicrobial and moisture wicking properties stem from the UHMWPE being hydrophobic. The good tensile properties of the UHMWPE fiber also resist ripping or otherwise wearing out or failing of the knit. In some embodiments, the UHMWPE fiber has a variation of the denier along the length of said UHMWPE fiber. In some embodiments, a variation of the denier along the length of said UHMWPE fiber is less than ±2.5%, less than ±3%, less than ±3.5%, less than ±4%, less than ±5%, less than ±6%, less than ±7%, less than ±8%, or less than ±9%, or less than ±10%. In some embodiments, the UHMWPE fiber has a variation of the diameter along the length of said UHMWPE fiber is less than ±2.5%, less than ±3%, less than ±3.5%, less than ±4%, less than ±5%, less than ±6%, less than ±7%, less than ±8%, or less than ±9%, or less than ±10%. In some embodiments, the UHMWPE fiber has a cross sectional shape substantially resembling a circle. In some embodiments, the UHMWPE fiber has a cross sectional shape substantially resembling an oval. In some embodiments, the UHMWPE fiber has a cross sectional shape substantially resembling a stadium. In some embodiments, the UHMWPE fiber has a cross sectional shape substantially resembling an ellipse. In some embodiments, the UHMWPE fiber has a cross sectional shape which remains substantially constant along the length of the fiber.

The amount of the UHMWPE fiber in the knit may be in the range of from about 10% by weight to about 90% by weight based on the total amount of fibers in the knit. In some embodiments, the amount of the UHMWPE fiber in the knit ranges from about 15% by weight to about 80% by weight, from about 20% by weight to about 80% by weight, from about 30% by weight by weight to about 70% by weight or from about 40% by weight to about 60% by weight. A higher UHMWPE fiber content means a more durable end product with greater antimicrobial properties.

In some embodiments, the knit comprises a plurality of UHMWPE fibers. Each of the UHMWPE fibers includes multiple microfilaments, each of the microfilaments having a denier of 5 or less. Each of the UHMWPE fibers may comprise 50 or less microfilaments.

The companion fiber is selected to enhance a property of the knit, such as, but not limited to, the comfort, durability, dyeability/printability, and/or stretchability of the knit. In some embodiments, the companion fiber comprises a single fiber. In some other embodiments, the companion fiber comprises a plurality of fibers.

The companion fiber may be a synthetic fiber, a natural fiber, a stretch fiber, a non-stretch fiber, a high performance fiber, an elastomeric fiber, a thermoplastic fiber, an abrasion resistant fiber, or a memory fiber.

In some embodiments, the companion fiber comprises a synthetic fiber. Non limiting examples of organic synthetic fibers include those made of: polyolefin such as polyethylene, polypropylene, high molecular weight polypropylene, polybutylene and the like; polyamide such as nylon; polyester such as polyethylene terephthalate, polyethylene naphthalate, poly (ethylene succinate), polymethyl methacrylate; 1,2-polybutadiene; acrylonitrile-butadiene-styrene copolymer; polystyrene; and copolymers of these polymers.

In some embodiments, the companion fiber comprises a natural fiber. Examples of natural fibers include cotton, silk, wool and the like.

In some embodiments, the companion fiber comprises a stretch fiber. Examples of stretch fibers include those made of polyurethane, polyolefin such as low molecular weight polyethylene, polyamide or polypropylene, and the like.

In some embodiments, the companion fiber comprises a non-stretch fiber which as used herein refers to class of fibers which is substantially non-elastic with little or no elongation. Examples of non-stretch fibers include those made of polyester, cotton, nylon, rayon, and wool.

In some embodiments, the companion fiber comprises a high performance fiber. Examples of high performance fibers include high molecular weight polypropylenes, aramids, high molecular weight polyvinyl alcohols, high molecular weight polyacrylonitriles, and liquid crystal polyesters.

In some embodiments, the companion fiber comprises an elastomeric fiber which as used herein refers to a fiber which has a break elongation in excess of 100% and which when stretched and released, retracts quickly and forcibly to substantially its original length. Examples of elastomeric fibers include spandex (also called elastane), lastol, polyurethane, and polyetherester.

In some embodiments, the companion fiber comprises a thermoplastic fiber which as used herein refers to class of fibers obtained from polymer that is plastic or deformable, melts to a liquid when heated and freezes to a brittle, glassy state when cooled sufficiently. Examples of thermoplastic fibers include those made of polyamides, polyimides, polyurethanes, polyolefins, polystyrenes, aromatic polyesters, polycarbonates, polyketones, polyureas, polyvinyl resins, polyacrylates, and polymethacrylates.

In some embodiments, the companion fiber comprises an abrasion resistant fiber which as used herein refers to class of fibers that inhibits or reduces abrasion of the material that it is proximate to. Examples of abrasion resistant fibers include those made of nylon, polyesters and polyamides.

In some embodiments, the companion fiber comprises a memory fiber which as used herein refers to class of fibers having ability to return to some previously defined shape or size when subjected to an appropriate thermal stimulus. Examples of memory fibers include those made of polynorbornenes, styrene-butadiene copolymers, polyurethanes, and transpolyisoprenes.

In some embodiments, the companion fiber is a composite fiber formed by coating a first fiber with a second fiber. In some embodiments, the composite fiber is formed by coating a monofilament spandex fiber with a multifilament nylon fiber. In some embodiments, the first fiber and the second fiber are twisted.

The companion fiber may include any suitable number of microfilaments. In some embodiments, the companion fiber comprises 2 to 400 microfilaments, 10 to 300 microfilaments, 10 to 200 microfilaments, 10 to 150 microfilaments, 10 to 100 microfilaments, 10 to 50 microfilaments, 5 to 50 microfilaments, or 20 to 200 microfilaments.

The companion fiber may be of any suitable denier. In some embodiments, the companion fiber has a denier ranging from about 2 to about 100, from about 5 to about 100, from about 10 to about 100, or from about 15 to about 100. In some embodiments, the companion fiber has a denier of about 5, about 10, about 13, about 15, about 17, about 20, about 25, about 30, about 50, about 60, about 70, about 80, or about 90. In instances where the knit comprises a plurality of companion fibers, the plurality of companion fibers may have the same or different deniers from each other.

In some embodiments, the companion fiber allows an elongation of greater than 100%. In some embodiments, the companion fiber has an elongation of about 130% or greater, about 200% or greater, about 300% or greater, or about 400% or greater.

In some embodiments, the companion fiber is a colored fiber comprising a dye. In some embodiments, the companion fiber has black, blue, grey, red, blue, brown, yellow, green, orange, or nude color. In some embodiments, the companion fiber is white color. In some embodiments, the companion fiber has a same color as the UHMWPE fiber. In some other embodiments, the companion fibers have a different color form the UHMWPE fiber.

The knit has a high dimensional stability. In some embodiments, the dimension dimensional stability of the knit in each of a length direction and a width direction is of about ±6%, about ±4%, about ±2%, about ±1%, or about ±0.5%.

The knit is substantially hydrophobic. In some embodiments, the knit has a contact angle with water ranging from about 45 degrees to about 135 degrees, when measured in air. In some embodiments, the contact angle of the knit with water is greater than about 45 degrees, greater than about 50 degrees, greater than about 60 degrees, greater than about 80 degrees, greater than about 90 degrees, greater than about 100 degrees, greater than about 110 degrees, greater than about 120 degrees, greater than about 125 degrees, or greater than about 130 degrees. In some embodiments, the contact angle of the knit with water is about 120 degrees.

The knit is biologically inert, and thus does not stimulate undesired growth nor is sensitive to any attack by microorganisms. In some embodiments, the knit provides an antimicrobial reduction in the range of about 25% to about 100% comparing to a knit comprised of cotton. In some embodiments, the knit provides an antimicrobial reduction in the range of about 25% to about 75% comparing to the knit comprised of cotton. In some embodiments, the knit provides an antimicrobial reduction in the range of about 25% to about 50% comparing to the knit comprised of cotton. In some embodiments, the knit provides at least 50% of antimicrobial reduction when comprising to the knit comprised of cotton.

The knit also has a good odor resistance and does not substantially absorb smell or body odor.

The knit has an apparent denier of about 150 or less, about 120 or less, about 100 or less, about 80 or less, about 60 or less, about 50 or less, about 40 or less or about 30 or less.

The knit of the present disclosure can be produced using a knitting machine as described for example in United States Patent Publication No. 20222256620, incorporated herein by reference in its entirety In some embodiments, the knit is produced using a UHMWPE fiber and a nylon coated spandex fiber as the companion fiber. Both the UHMWPE fiber and the companion fiber may be textured or flat. In some embodiments, the nylon has a denier ranging from 1 to 20. In some embodiments, the nylon has a denier ranging from 5 to 20. In some embodiments, the nylon is a multifilament fiber including 5 to 16 microfilaments. In some embodiments, the nylon coated spandex fiber is formed by coating a monofilament spandex fiber having a denier of 17 with a nylon fiber containing 5 to 20 microfilaments and having a denier ranging from 1 to 20. In some embodiments, the knit has a course alternating between the UHMWPE fiber and the nylon coated spandex fiber, in which the spandex fiber is a monofilament fiber having a denier of 40and the nylon fiber is a multifilament fiber containing 7 microfilaments and having a denier of 20. In some embodiments, the resulting knit has an apparent denier ranging from 15 to 60. In some embodiments, the resulting knit has an apparent denier of about 40.

In some embodiments, the knit is produced using a UHMWPE fiber and a nylon fiber. The nylon fiber is a multifilament fiber containing 40 microfilaments and having a denier of 40.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A clothing article comprising:

at least one base knit region, each base knit region being formed of a base knit comprising an ultra-high molecular weight polyethylene (UHMWPE) fiber and at least one base stretch fiber being knit together in a plated configuration to form a jersey knit; and at least one reinforcing knit region, each reinforcing knit region being formed of a reinforcing knit comprising the UHMWPE fiber and the at least one base stretch fiber being knit together in a plated configuration to form a jersey knit, the reinforcing knit region further comprising a reinforcing stretch fiber being alternatingly knit with the jersey knit of the reinforcing knit in which within each given course of the jersey knit of the reinforcing knit, for every sequence of m+n consecutive loops of the course, the reinforcing stretch fiber is looped with m consecutive loops of the jersey knit of the reinforcing knit and n consecutive loops of the jersey knit of the reinforcing knit (following the m consecutive loops) are free of looping with the reinforcing stretch fiber.

2. The clothing article of claim 1, wherein the at least one base knit region and the at least one reinforced knit region are integrally formed from a continuous knitting operation;

wherein m is equal to or greater than 1 and n is equal to or greater than 1;

wherein the clothing article further comprises at least one pinched region having a pinched stitch;

wherein the UHMWPE fiber comprises a plurality of UHMWPE microfilaments; and/or wherein an elasticity of the at least one base knit region is greater than an elasticity of the at least one reinforcing knit region.

3. The clothing article of claim 1, wherein the at least one reinforcing knit region comprises at least one vertical reinforcing knit region, the sequence of m+n consecutive loops of any given course of the vertical reinforcing knit region being aligned with the sequence of m+n consecutive loops of any other course of the vertical reinforcing knit region.

4. The clothing article of claim 1, wherein the at least one reinforcing knit region comprises at least one diagonal reinforcing knit region; and/or wherein for at least one set of two immediately adjacent courses of the diagonal reinforcing knit region, the sequence of m+n consecutive loops of a first course of the set of two immediately adjacent courses is offset from the sequence of m+n consecutive loops of a second course of the set of two immediately adjacent courses.

5. The clothing article of claim 4, wherein the at least one diagonal reinforcing knit region comprises an S-oriented diagonal reinforcing knit region;

wherein the S-oriented diagonal reinforcing knit region comprises a plurality of sets of two immediately adjacent courses having the offset of the sequence of m+n consecutive loops of the first course and the second course of the two immediately adjacent courses; and wherein the offset of the sequence of m+n courses consecutive loops of the first course and the second course of each of the plurality of sets of two immediately adjacent courses is offset in a same leftwise direction.

6. The clothing article of claim 4, wherein the at least one diagonal reinforcing knit region comprises a Z-oriented diagonal reinforcing knit region;

wherein the Z-oriented diagonal reinforcing knit region comprises a plurality of set of two immediately adjacent courses having the offset of the sequence of m+n consecutive loops of the first course and the second course of the two immediately adjacent courses; and wherein the offset of the sequence of m+n consecutive loops of the first course and the second course of each of the plurality of sets of two immediately adjacent courses is offset in a same rightwise direction.

7. The clothing article of claim 4, wherein the at least one reinforcing knit region comprises at least one checkered reinforcing knit region;

wherein for at least one first set of two immediately adjacent courses of the diagonal reinforcing knit region, the sequence of m+n consecutive loops of a first course of the first set of two immediately adjacent courses is offset in a first direction from the sequence of m+n consecutive loops of a second course of the first set of two immediately adjacent courses; and wherein for at least one second set of two immediately adjacent courses of the diagonal reinforcing knit region, the sequence of m+n consecutive loops of a first course of the second set of two immediately adjacent courses is offset in a second direction, being opposite the first direction, from the sequence of m+n consecutive loops of a second course of the second set of two immediately adjacent courses.

8. The clothing article of claim 1, wherein the clothing article is a breast support garment comprising a waistband;

wherein the at least one base knit region comprises:

a first breast region;

a second breast region;

an upper back region;

a first strap region extending from an upper edge of the first breast region to the upper back region;

a second strap region extending from an upper edge of the second breast region to the upper back region; and wherein the at least one reinforcing knit region comprises:

a first breast reinforcing region extending from a lower edge of the first breast region to an upper edge of the waistband;

a second breast reinforcing region extending from a lower edge of the second breast region to the upper edge of the waistband; and a central reinforcing region defined between the first and second breast regions and extending downwardly to the upper edge of the waistband;

and optionally one or more of wherein the waistband is free of UHMWPE.

wherein the at least one reinforcing knit region further comprises a back reinforcing region extending from a lower edge of the upper back region to the upper edge of the waistband;

wherein the at least one base knit region has an apparent denier of 40 or less, 30 denier or less or 20 denier or less; and/or wherein the at least one reinforcing knit region has an apparent denier of about 60 to about 120, about 70 to about 110 or about 80 to about 100;

wherein the stretch fiber comprises spandex, polypropylene, polyurethane, polyolefin and polyester fibers, and combinations thereof; and wherein the base knit and/or the reinforcing knit further comprise one or more companion fiber.

9. The clothing article of claim 8, wherein the at least one reinforcing knit region further comprises:

a first lateral reinforcing region extending between the first breast reinforcing region and the back reinforcing region and extending longitudinally between a lower edge defining a first armhole of the clothing article and the upper edge of the waistband; and a second lateral reinforcing region extending between the second breast reinforcing region and the back reinforcing region and extending longitudinally between a lower edge defining a second armhole of the clothing article and the upper edge of the waist band; and optionally comprises wherein the reinforcing regions are vertical reinforcing knit regions, the sequence of m+n consecutive loops of any given course of the vertical reinforcing knit regions being aligned with the sequence of m+n consecutive loops of any other course of the vertical reinforcing knit regions, and/or wherein the first breast reinforcing region, the second breast reinforcing region, the central breast reinforcing region, the back reinforcing region, the first lateral reinforcing region and the second lateral reinforcing region form a single contiguous reinforcing region.

10. The clothing article of claim 8, wherein a support band for providing breast support is formed on the at least one reinforcing knit region;

and optionally wherein the support band is a single contiguous support band, preferably wherein the support band is configured to contour the underside of a wearer's breasts; and/or wherein the clothing article is a breast support garment, preferably a bra, preferably a bralette or a racerback bra; or a tank, preferably a crop top.

11. The clothing article of claim 10, wherein the support band is W-shaped, extending from the first lateral reinforcing region, through the first breast reinforcing region, upwardly into the central reinforcing region, through the second breast reinforcing region and to the second lateral reinforcing region; and optionally wherein the first and second ends of the support band extend upwardly towards the lower edges defining the first and second armholes, respectively; and/or wherein the support band is formed of cording.

12. The clothing article of claim 1, wherein the clothing article is an underpant comprising a waistband, a gusset, a first bottom end and a second bottom end, the first and second bottom ends defining a first leg hole and a second leg hole, respectively; wherein the at least one base knit region comprises a rear region of a rear portion of the clothing article; and optionally wherein the underpant is a brief, optionally a hipster brief or a high-rise brief, or a boyshort;

wherein the at least one base knit region further comprises a front region; and/or wherein the at least one base knit region further comprises a first front base region extending longitudinally from an intermediate position between the waistband and the first bottom end of the front portion of the clothing article to the waistband, and optionally extending laterally from the left side of the clothing article towards a center portion of the front portion of the clothing article.

13. The clothing article of claim 12, wherein the at least one reinforcing knit region comprises:

a vertical reinforcing region extending over a center sub-portion of a front portion of the clothing article;

a first S-oriented diagonal reinforcing knit region extending from a left side of the vertical reinforcing region; and/or a first Z-oriented diagonal reinforcing knit region extending from a right side of the vertical reinforcing region; or wherein the at least one reinforcing knit region comprises:

a first S-oriented diagonal reinforcing knit region extending from a right side of a center portion of a front portion of the clothing article towards the rear portion of the clothing article or from a left side of the center portion of the front portion of the clothing article towards the rear portion of the clothing article; and/or a first Z-oriented diagonal reinforcing knit region extending from the left side of the center portion of the front portion of the clothing article or from the right side of the center portion of the front portion of the clothing article towards the rear portion of the clothing article; and/or wherein the at least one base knit region further comprises a second front base region extending longitudinally from an intermediate position between the waistband and the second bottom end of the clothing article to the waistband, optionally extending laterally from the right side of the front portion of the clothing article towards a center portion of the front portion of the clothing article.

14. The clothing article of claim 8, wherein one or more of the reinforcing knit regions extends longitudinally from the waistband to the first or second bottom end of the clothing article;

wherein the vertical reinforcing region extends from the waistband to the gusset;

wherein the first S-oriented diagonal reinforcing knit region extends from the waistband to the first or second bottom end of the clothing article; and/or wherein the first Z-oriented diagonal reinforcing knit region extends from the waistband to the first or second bottom end of the clothing article.

15. The clothing article of claim 8, wherein the at least one reinforcing knit region further comprises:

a second Z-oriented diagonal reinforcing knit region extending from a left edge of the front portion of the clothing article to an outer edge of the first S-oriented diagonal reinforcing knit region extending from the left side of the center portion of the front portion of the clothing article;

a first checkered reinforcing knit region extending between the S-oriented diagonal reinforcing knit region extending from the left side of the center portion of the front portion of the clothing article and the second Z-oriented diagonal reinforcing knit within the front portion of the clothing article;

a second S-oriented diagonal reinforcing knit region extending from a right edge of the front portion of the clothing article to an outer edge of the first Z-oriented diagonal reinforcing knit region extending from the right side of the center portion of the front portion of the clothing article; and/or a second checkered reinforcing knit region extending between the first Z-oriented diagonal reinforcing knit region extending from the right side of the center portion of the front portion of the clothing article and the second S-oriented diagonal reinforcing knit within the front portion of the clothing article; and optionally wherein the second Z-oriented diagonal reinforcing knit region extends longitudinally from an intermediate position between the waistband and the first bottom end of the clothing article to the first bottom end of the clothing article;

and/or wherein the second S-oriented diagonal reinforcing knit region further extends longitudinally from an intermediate position between the waistband and the second bottom end of the clothing article to the second bottom end of the clothing article.

16. The clothing article of any one of claim 13, wherein the at least one reinforcing knit region further comprises:

a third Z-oriented diagonal reinforcing knit region extending from a left edge of the rear portion of the clothing article; and/or a third S-oriented diagonal reinforcing knit region extending along a right edge of the rear portion of the clothing article; and optionally wherein the third S-oriented diagonal reinforcing knit region extending from the right edge of the rear portion of the clothing article and the second Z-oriented diagonal reinforcing knit region extending from the left edge of the front portion of the clothing article are joined together to form a first chevron pattern; and/or wherein the third Z-oriented diagonal reinforcing knit region extending from the left edge of the rear portion of the clothing article and the second S-oriented diagonal reinforcing knit region extending from the right edge of the front portion of the clothing article are joined together to form a second chevron pattern.

* * * * *